US012613073B2

(12) United States Patent
Popovic et al.

(10) Patent No.: US 12,613,073 B2
(45) Date of Patent: Apr. 28, 2026

(54) APPARATUS, METHODS, AND SYSTEM FOR RETARDING HEAT DISSIPATING FROM THE BARREL OF A FIREARM

(71) Applicant: Eric Popovic, Fort Myers, FL (US)

(72) Inventors: Eric Popovic, Fort Myers, FL (US); Dwight Popovic, Fort Myers, FL (US)

( * ) Notice: Subject to any disclaimer, the term of this patent is extended or adjusted under 35 U.S.C. 154(b) by 121 days.

(21) Appl. No.: 18/653,876

(22) Filed: May 2, 2024

(65) Prior Publication Data

US 2026/0016253 A1 Jan. 15, 2026

Related U.S. Application Data

(60) Provisional application No. 63/463,361, filed on May 2, 2023.

(51) Int. Cl.
*F41A 21/44* (2006.01)
*F41A 21/32* (2006.01)

(52) U.S. Cl.
CPC ..... *F41A 21/44* (2013.01); *F41A 21/325* (2013.01)

(58) Field of Classification Search
CPC ..... F41A 21/44; F41A 21/325
See application file for complete search history.

(56) References Cited

U.S. PATENT DOCUMENTS 2,364,340 A * 12/1944 Bogg, Jr. ..... F41A 35/02 42/106
2,932,334 A * 4/1960 Steen ..... F41A 35/02 206/317
3,437,247 A * 4/1969 Gantress ..... F41C 33/06 D3/904
3,701,371 A * 10/1972 Stackhouse ..... F41C 33/06 383/103
4,346,643 A * 8/1982 Taylor ..... F41A 21/44 165/104.26
4,424,734 A * 1/1984 Janssen ..... F41A 21/44 89/16
RE32,752 E * 9/1988 Kiang ..... F41H 3/00 42/74
4,858,361 A * 8/1989 White ..... F41A 35/02 206/316.1
5,048,217 A * 9/1991 Easter ..... F41A 35/02 42/96

(Continued)

*Primary Examiner* — Michelle Clement
(74) *Attorney, Agent, or Firm* — Derek Fahey, Esq.; The Plus IP Firm, PLLC

(57) ABSTRACT

A heat retardant system for covering a barrel of a firearm is disclosed. The system comprises a tubular sleeve with innermost and outermost layers, first and second end portions each having an opening, and a fastener for securing the sleeve to the firearm. The tubular sleeve spans substantially the entire barrel, enhancing heat management. The innermost layer comprises a heat tolerant material that forms a retardant channel enveloping the barrel. Additional features include a first section on the outermost layer covering portions of the inner layer, vents for improved heat dissipation, and a rigid stabilizer to maintain the sleeve's upright position. An elastic cord fastener and a unique configuration with a cutout facilitate attachment to firearm components. This system is adaptable for various firearm designs, significantly improving heat management while maintaining barrel accessibility and safety during use.

18 Claims, 12 Drawing Sheets

(56) References Cited

U.S. PATENT DOCUMENTS 5,094,376 A * 3/1992 Baruch ..... F41C 33/0263 224/244
5,678,344 A * 10/1997 Jones ..... F41C 33/06 42/96
6,019,404 A * 2/2000 Pasquale ..... F41A 17/44 294/219
6,722,073 B2 * 4/2004 Cossio ..... F41A 35/04 42/74
7,185,607 B1 * 3/2007 Pearson ..... F41C 33/06 42/96
7,757,421 B1 * 7/2010 Tompkins ..... F41A 35/02 206/317
8,307,577 B2 * 11/2012 Baxter ..... F41A 35/02 206/317
9,175,920 B2 * 11/2015 Moore ..... F41A 21/44
9,506,713 B2 * 11/2016 Frazier ..... F41A 35/02
10,024,619 B2 * 7/2018 Almazan ..... F41A 21/44
10,161,700 B2 * 12/2018 Klett ..... F41A 13/12
10,175,020 B2 * 1/2019 Newcomb ..... F41A 23/02
10,302,384 B1 5/2019 Lee
D850,789 S * 6/2019 Corriero ..... D3/222
10,539,391 B2 * 1/2020 Bridgman, Jr. ..... F41G 1/383
10,578,391 B2 * 3/2020 Scott ..... F41C 33/06
11,635,273 B2 * 4/2023 Wrecsics, Jr. ..... F41C 33/08 42/90
11,808,538 B2 * 11/2023 Deeter ..... F41A 35/04
11,937,676 B2 * 3/2024 Dooling ..... F41A 35/02
12,078,443 B2 * 9/2024 Wrecsics, Jr. ..... F41C 33/08
12,092,412 B1 * 9/2024 Weimer ..... F41A 35/02
2007/0062090 A1 * 3/2007 Brindle ..... F41A 35/02 206/317
2008/0110076 A1 * 5/2008 Bennett ..... F41C 33/06 42/96
2009/0209155 A1 * 8/2009 Goulet ..... B32B 15/14 156/92
2010/0170135 A1 * 7/2010 Tompkins ..... F41A 35/04 42/96
2012/0137566 A1 * 6/2012 Baxter ..... F41A 35/02 42/96
2014/0150321 A1 * 6/2014 Fitzgerald ..... F41A 35/00 2/16
2014/0190602 A1 * 7/2014 Utech ..... F41A 35/02 150/154
2015/0285580 A1 * 10/2015 Utech ..... F41A 35/02 42/96
2015/0343738 A1 12/2015 Strauss
2016/0076845 A1 * 3/2016 Almazan ..... F41A 21/44 42/96
2018/0202768 A1 * 7/2018 Bridgman, Jr. ..... F41G 1/383
2021/0033367 A1 * 2/2021 Kummer ..... F41C 33/06
2021/0404761 A1 * 12/2021 Le Sage ..... F41A 21/44
2022/0082348 A1 * 3/2022 Kummer ..... F41A 35/02
2022/0146227 A1 * 5/2022 Kovac ..... F41A 21/44
2022/0404605 A1 * 12/2022 Holzmann ..... G02B 5/003
2023/0175805 A1 * 6/2023 Kummer ..... F41C 33/06 206/317
2024/0093960 A1 * 3/2024 Kummer ..... F41A 35/02
2024/0230277 A1 * 7/2024 Ramirez ..... F41C 33/06
2024/0341431 A1 * 10/2024 Dooling ..... A45C 13/008
2024/0426567 A1 * 12/2024 Wrecsics, Jr. ..... F41C 33/08
2025/0341377 A1 * 11/2025 Kangasniemi ..... F41A 21/30

* cited by examiner

APPARATUS, METHODS, AND SYSTEM FOR RETARDING HEAT DISSIPATING FROM THE BARREL OF A FIREARM

CROSS-REFERENCE TO RELATED APPLICATIONS

This application is a non-provisional which claims the benefit of the filing date of U.S. Provisional Application Ser. No. 63/463,361 titled "Apparatus, Methods, And System For Retarding Heat Dissipating From The Barrel Of A Firearm" and filed May 2, 2023 and the subject matter of which is incorporated herein by reference.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not applicable.

TECHNICAL FIELD

The present disclosure relates to the field of firearm accessories, and more specifically to the field of heat mitigating firearm coverings.

BACKGROUND

When shooting a firearm, typically after firing a few rounds in quick succession, the barrel of a rifle can become quite hot. The temperature of the barrel can range from a few hundred degrees Fahrenheit up to around a thousand degrees Fahrenheit, depending on the specific circumstances. The heat waves, traveling from the barrel to the outside environment, create an optical illusion blurring or distorting a person's vision, also known as a mirage. This may cause sighting errors and may lead to dangerous consequences. Therefore, it is essential to allow the barrel to cool down before firing again to avoid irreversible mistakes, object burns, and personnel contact burns. However, this cool down period is not always available to a person handling a firearm. For example, if a person is being attacked by another person or animal, they may need to fire multiple rounds in quick succession to defend and protect themselves. In this circumstance, the operator would need clear sight of the attacker in order to safely and accurately aim and fire the gun. Heat waves obscuring the vision of the operator could result in a deadly outcome.

Another example of when a user would be firing a firearm in quick succession would be during military combat. Combat can be highly dynamic and unpredictable, having both sides constantly adapting to changing circumstances. A soldier may need to fire several rounds at one location then immediately move to another location. The gun barrel is hot, as mentioned above, after a few rounds and now must be transported elsewhere. If the gun barrel touches anything while its temperature is at hundreds or over a thousand degrees Fahrenheit, it will burn through whatever it comes in contact with.

More common, discharging a firearm in quick or rapid succession is a typical practice at firing ranges and shooting facilities. As previously stated, after firing a few rounds in quick succession, the barrel of a rifle can become quite hot, up to around 1,000 degrees Fahrenheit. However, automatic rifles or machine guns, which are even designed to fire rapidly, result in a barrel heating up extremely quickly from the increased rate of fire. After firing a few rounds in quick succession, the barrel of a machine gun, for example, can reach temperatures of several hundred degrees Fahrenheit, and in some cases, even exceed 1,000 degrees Fahrenheit. For example, a heavy machine gun firing continuously with a high rate of fire can cause the barrel to reach temperatures of up to 1,200 to 1,500 degrees Fahrenheit or even higher.

Thus, it is essential to allow the barrel to cool down before firing again to avoid overheating, which can damage the barrel and affect accuracy. A good rule of thumb is to wait at least a few minutes between shots to let the barrel cool down, especially if you plan to fire multiple rounds in quick succession. For a short rapid succession of discharging a semi-automatic firearm, it is recommended to wait at least a few minutes between shots to let the barrel cool down, while for a machine gun, it may take longer, around 5-10 minutes, depending on the specific circumstances. However, if the barrel has been subjected to sustained firing or high rates of fire, it may take longer to cool down, possibly up to an hour or more. It's important to keep an eye on the barrel temperature and wait until it has cooled down sufficiently before firing again to prevent damage to the barrel and maintain accuracy.

In each of the above examples by which a person may experience a situation where they rapidly discharge a firearm, the user must have a place to put the firearm after it has been shot. For the hunter or military combat, this may involve wearing fire protectant gloves or placing the firearm in a backpack or case. However, the problem with protective gloves is that only the direct wearer of the gloves is protected from contact burns. Other objects may contact the hot barrel and ignite or become damaged. Additionally, another person may grab the firearm by the barrel unknowing that it is hot.

With respect to gun cases, current gun cases are generally made of foam, which easily melts when it comes into contact with a hot surface. For a person at a firing range who is waiting for the barrel of the firearm to cool down so that the user can either leave and/or refire the weapon, most commonly, the user places the firearm into a backpack and/or leaves the firearm in the open. Again, this poses problems with respect to contact burns for both people and objections.

To prevent contact burns or vision impairment, people have created insulated firearm covers, such as United States Patent Application Publication US2022/0146227A1 (the "227 Application"). The 227 Application discloses a flexible barrel cover made from a material having a melting point of roughly nine hundred degrees Fahrenheit. The 227 Application is not applicable to situations sustaining rapid fire or prolonged firing, as hot barrel would burn through and damage the insulated material. Additionally, for prior art such as the 227 Application, a problem lies with being able to rapidly secure and remove the cover to and from the firearm, which is important for situations which require quick response timing, such as military combat. Moreso, a problem with the prior art is that the heat is generally contained within the cover, acting as an insulator of the barrel rather than facilitating in dissipating heat. As a result, there exists a need for improvements over the prior art and more particularly for a more efficient heat retardant system for covering a barrel of a firearm.

SUMMARY

A heat retardant system for covering a barrel of a firearm is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a heat retardant system for covering a barrel of a firearm is disclosed. The system comprises a tubular sleeve comprising a first end portion and a second end portion, an innermost layer of the tubular sleeve, an outermost layer the tubular sleeve attached to the innermost layer of the tubular sleeve, a first opening at the first end portion of the tubular sleeve, a second opening at the second end portion of the tubular sleeve, and a fastener attached to opposing sides of the first end portion of the tubular sleeve. The tubular sleeve spans substantially all the barrel of the firearm. The fastener secures the tubular sleeve to a rearward portion of the firearm. The innermost layer of the tubular sleeve comprises a heat tolerant material defining a retardant channel extending through the tubular sleeve for substantially covering the barrel of the firearm. The system further includes a first section on the outermost layer of the tubular sleeve proximate to each of the first end portion and the second end portion. The first section is defined by the innermost layer of the tubular sleeve wrapping about a perimeter of each respective end portion and covering at least a portion of the outermost layer. The first opening receives the barrel of the firearm and wherein the second opening provides heat dissipation from the barrel. The fastener is an elastic cord coupled to the tubular sleeve for attaching to the rearward portion of the firearm. The heat tolerant material comprises a heat resistance of up to 1800 degrees Fahrenheit. The system further includes a rigid stabilizer on at least one of a top portion and a bottom portion of the tubular sleeve, wherein the rigid stabilizer extends longitudinally about of the tubular sleeve for maintaining the tubular sleeve in an upright position. A side of the tubular sleeve comprises a cutout extending at least partially the length of the tubular sleeve, wherein an opening of the cutout receives an attachment to the firearm. The cutout is on a bottom facing portion of the tubular sleeve and extends from a middle portion of the tubular sleeve to the first end portion of the tubular sleeve for sliding over the attachment to the firearm. The system further includes a plurality of vents about the tubular sleeve, the plurality of vents extending through the outermost layer of the tubular sleeve to the innermost layer.

The length of the tubular sleeve is such that it covers substantially all of the length of the barrel, extending from at or near the point where the barrel connects to the upper receiver to the end of the barrel (shown in FIG. 1A, which may include, in certain embodiments, covering at least a portion (or the entirety as shown in FIG. 1B) of a barrel attachment, which includes, but is not limited to, a muzzle break, compensator, flash hider, and/or suppressor.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the disclosure and together with the description, explain the principles of the disclosed embodiments. The embodiments illustrated herein are presently preferred, it being understood, however, that the disclosure is not limited to the precise arrangements and instrumentalities shown, wherein.

Like reference numerals refer to like parts throughout the various views of the drawings.

DETAILED DESCRIPTION

Figure 1A:
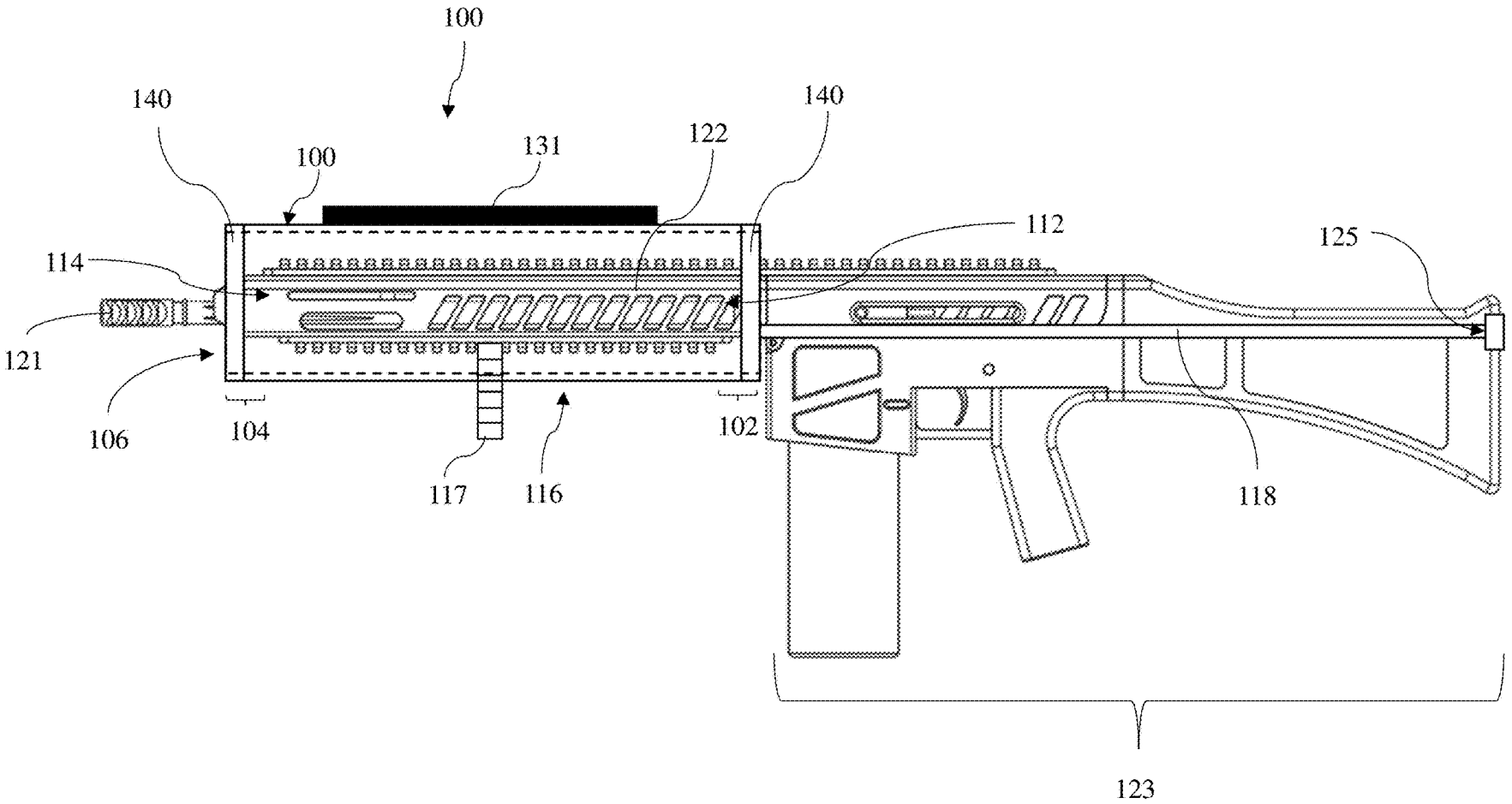
FIG. 1A is a side view of a tubular sleeve substantially covering a barrel of a firearm, according to an example embodiment.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions, or modifications may be made to the elements illustrated in the drawings, and the methods described herein may be modified by substituting reordering or adding additional stages or components to the disclosed methods and devices. Accordingly, the following detailed description does not limit the disclosed embodiments. Instead, the proper scope of the disclosed embodiments is defined by the appended claims.

The disclosed embodiments improve upon the problems with the prior art by providing a heat retardant system for covering a barrel of a firearm. The system including a tubular sleeve made from heat tolerant material that will not burn or scorch at a temperature of up to 1800 degrees Fahrenheit allowing for rapid or prolonged firing of the firearm without damage to the tubular sleeve. The system also prevents the barrel from burning its external environment when the firearm is stored or simply placed down.

The heat tolerant materials such as carbon felt in the innermost layer increases the system's durability and heat resistance. These materials can withstand extremely high temperatures and provide superior insulation compared to traditional materials.

The temperature reactive indicator on the outermost layer provides real-time heat status feedback. This enhancement helps users monitor the system's performance and make adjustments as necessary to maintain optimal operating conditions. The temperature reactive indicator enhances the system by providing dynamic heat monitoring. This element allows users to make informed decisions about the operation and safety of their firearm, particularly in scenarios where overheating can lead to malfunction or damage. It also increases the user's situational awareness and contributes to maintaining the firearm in optimal working condition by preventing overheating.

The perimeter extension also represents an improvement over previous designs that might not fully address the vulnerabilities at the edges of protective systems. This feature of the perimeter extension enhances the longevity and effectiveness of the heat retardant system by providing a more comprehensive coverage, thereby reducing maintenance frequency and improving user safety.

Referring now to the figures, FIGS. 1A-5 depict an example embodiment of the heat retardant system 100 for covering a firearm barrel 122. The system includes a tubular sleeve 100 with a first end portion 102 and a second end portion 104. It is important to note that the tubular sleeve in FIG. 1A appears transparent; however, this illustration is made for the purpose of showing the underlying barrel of the firearm contained within the retardant channel. The tubular sleeve is generally not a transparent material.

The tubular sleeve is a cylindrical cover designed to substantially cover the barrel of a firearm. It is formed by attaching two materials, an innermost flame-retardant layer and an outermost heat-resistant layer, together. The innermost layer defines a retardant channel that extends through the tubular sleeve, providing a flame-retardant material for the barrel of the firearm to be in contact with. The channel is not required to fit snuggly around the barrel but should provide enough coverage to protect against heat and potential ignition. The cylindrical cover is generally continuous and does not have any gaps or breaks. In certain embodiments, the cylindrical cover may have cutouts for receiving attachments, but is otherwise substantially continuous because gaps or breaks, such as an openable side, may compromise the effectiveness of the heat resistant material and the firearm and/or user at risk.

The retardant channel is formed by two materials, an outermost layer and an innermost layer, which are joined together to define a tubular shape. The outermost layer is positioned on the outside of the tubular sleeve and includes the first section of the sleeve near each end portion. The innermost layer is positioned on the inside of the tubular sleeve and is designed to withstand high temperatures. The two layers are joined together to form the retardant channel which provides a protective barrier between the firearm barrel and the outside environment. The retardant channel is designed to resist heat transfer from the barrel to the outer surface of the sleeve, thereby preventing any potential damage or burns to the user or the environment. The open ends of the retardant channel allow for quick and easy installation and removal of the sleeve from the firearm.

The innermost layer 106 of the tubular sleeve comprises a heat tolerant material that defines a retardant channel 120 extending through the tubular sleeve to substantially cover the firearm barrel. The outermost layer 108 of the tubular sleeve is attached to the innermost layer 106 of the tubular sleeve and may be made of various materials, such as synthetic materials like nylon, polyester, or polypropylene; natural materials like leather or wool; or other heat-resistant materials like silicone or Kevlar. Additionally, in certain embodiments, the outermost layer material may be a heavy-duty, woven fabric derived from materials such as cotton, linen, or a combination thereof, such as canvas. Such materials are known for its durability and strength, and it is often used for outdoor applications such as tents, sails, and tarps. The outermost layer materials can also be treated with various coatings to make it water-resistant or fire-resistant. Additionally, the outermost layer materials may include a variety of colors and patterns, for example, camouflage. However, it is important to ensure that any material used for the outermost layer of the tubular sleeve does not compromise the fire-retardant properties of the material on the innermost layer.

In some embodiments, the flame-retardant material on the innermost layer of the sleeve is a carbon based felt, which offers several benefits for this application. This material is lightweight, making it ideal for adding components or accessories to a firearm. Additionally, the felt is high strength and durable, which extends the lifetime of the product made from it. It is also corrosion-resistant, making it suitable for use in harsh environments, and thermal-resistant, making it an ideal material to use in high-temperature activities.

Furthermore, the tubular sleeve includes a first section on the outermost layer of the tubular sleeve near each end portion comprising the fire/heat resistant/retardant material. For the purposes of this disclosure, the heat-resistant material may be defined as a material with properties that prevent the material from burning or scorching at temperatures of less than 1800 degrees Fahrenheit (975.6 degrees Celsius). Having the fire/heat-resistant material around the edges of the openings of the tubular sleeve, extending on the outermost layer of the tubular sleeve, is critical to the effectiveness of the invention. It provides a layer of protection against heat and flame that may come in contact with the edges of the sleeve. This is especially important during rapid firing or other firearm uses where high temperatures can be generated. If the edges of the tubular sleeve were not made of heat-resistant material, there would be a high risk of ignition. During use, the barrel of the firearm can reach extremely high temperatures, and if the edges of the sleeve were to come into contact with the barrel, they could ignite. This could not only damage the sleeve, but also pose a serious safety hazard. Therefore, having the fire-resistant material around the edges of the sleeve is critical for ensuring the safety and effectiveness of the sleeve.

In certain embodiments, the cylindrical cover may be made of a single continuous material. In these embodiments, the outermost layer and innermost layer materials are the same, and the flame-retardant material surrounds the barrel of the firearm. This design may simplify the manufacturing process, as only one material needs to be sourced and processed.

However, ideally, the outermost layer material of the tubular sleeve is different from the innermost layer material. In certain instances, it may be advantageous to use separate materials for the innermost layer and outermost layer of the sleeve, as different materials may offer different benefits such as improved heat resistance or improved grip and also improve the lifetime durability of the sleeve by preventing unnecessary wear and tear on the inner material. Also, a second outermost layer material reinforces the durability and integrity of the inner material, thereby increasing the lifetime of the tubular sleeve.

In certain embodiments, the outermost layer material can include a different design, such as camouflage or a solid color, which may be beneficial in certain applications. For example, the camo design can help the firearm blend into its surroundings during hunting or military operations, making it less visible to potential targets. In other embodiments, the outermost layer material may include a different texture or surface pattern, such as a rubberized grip, which can enhance the operator's ability to maintain a firm grip on the firearm during use. Regardless of the specific design or texture, the outermost layer material remains heat-resistant and fire retardant, providing essential protection for the operator and equipment. This design provides an additional layer of protection against the spread of fire and helps to prevent the sleeve from slipping or shifting on the barrel of the firearm.

In certain embodiments, the innermost layer material of the tubular sleeve wraps around to the outermost layer to define the first section 140. This creates a continuous layer of fire/heat-resistant material around the entire circumference of the sleeve. The innermost layer and outermost layer materials may be attached by any suitable means, such as stitching, adhesives, or welding, to ensure that they remain securely in place. The stitching may be Kevlar® or other suitable material to maintain the integrity of the sleeve. Additionally, in certain embodiments, the stitching may be made of a heat resistant fiber consistent with this disclosure.

The sleeve includes a first opening 112 at the first end portion 102 of the sleeve for receiving an end of the barrel 121 for allowing the sleeve to slide over the barrel, a second opening 114 at the second end portion 104 of the sleeve. Both openings allow heat to dissipate from the barrel 122. A fastener 118 is attached to the first end portion of the sleeve on opposing sides of the first end portion 102 of the tubular sleeve for securing the tubular sleeve to a rearward portion 123 of the firearm. The rearward portion 123 of the firearm may include any portion of the firearm beyond the barrel, such as the receiver and stock for example.

The barrel 122 of a firearm may be defined and described as a long, tubular metal component that guides the projectile or shot out of the weapon. The barrel is often formed from high-quality steel and includes an interior surface that is precisely machined to provide a smooth, consistent bore. The exterior of the barrel may be finished in a variety of ways, including bluing or chrome plating, to enhance its durability and appearance. When a firearm is fired, a small explosion occurs inside the cartridge or shell casing, igniting the gunpowder and creating a burst of high-pressure gas. This gas propels the projectile or shot down the barrel at high velocity. When firing continuous shots, the barrel of the firearm may become hot due to the rapid expansion of gases generated by the combustion of gunpowder inside the shell. As the bullet moves down the barrel, it rubs against the inside walls, generating friction and heat. This heat is transferred to the metal of the barrel, which absorbs the energy and becomes hot.

The tubular sleeve 100 may be defined and described as a cylindrical or tube-shaped covering that is designed to fit over the barrel of a gun, providing protection and insulation. The size of the tubular sleeve may depend on the type of firearm. For example, a hunting rifle's barrel generally ranges from eighteen to twenty-six inches and has a diameter dependent on the size of the caliber. Therefore, a tubular sleeve used on a hunting rifle will typically be eighteen to twenty-six inches in length, while a short-barreled rifle may only need a tubular sleeve spanning less than sixteen inches long. The tubular sleeve first end portion 102 and second end portion 104 may be equivalent in size and shape or may be offset. For example, in the present embodiments, shown in FIGS. 1-5, the first and second end portions are substantially equal in size and shape. However, in other embodiments, the ends may be proportioned differently. For example, in some embodiments, the first or second end portion may be narrower for a more snug fit. The tubular sleeve may be manufactured using a variety of different processes, including sewing, casting, molding, folding, etc. The tubular sleeve may also be formed from a single piece of fabric and bonded to other fabrics, or it may be separate pieces merged or manufactured into one. Other types of manufacturing processes may also be used and are within the spirit and scope of the present invention.

Figure 5:
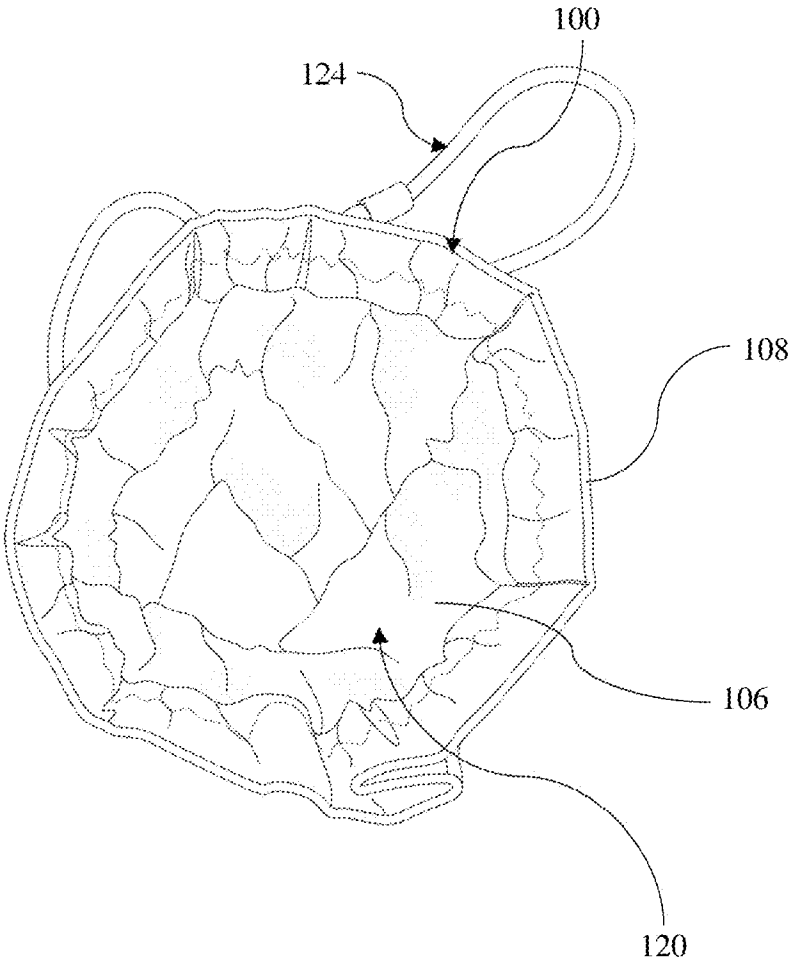
FIG. 5 is a front view of the tubular sleeve including an elastic fastener, according to an example embodiment.
Figure 6:
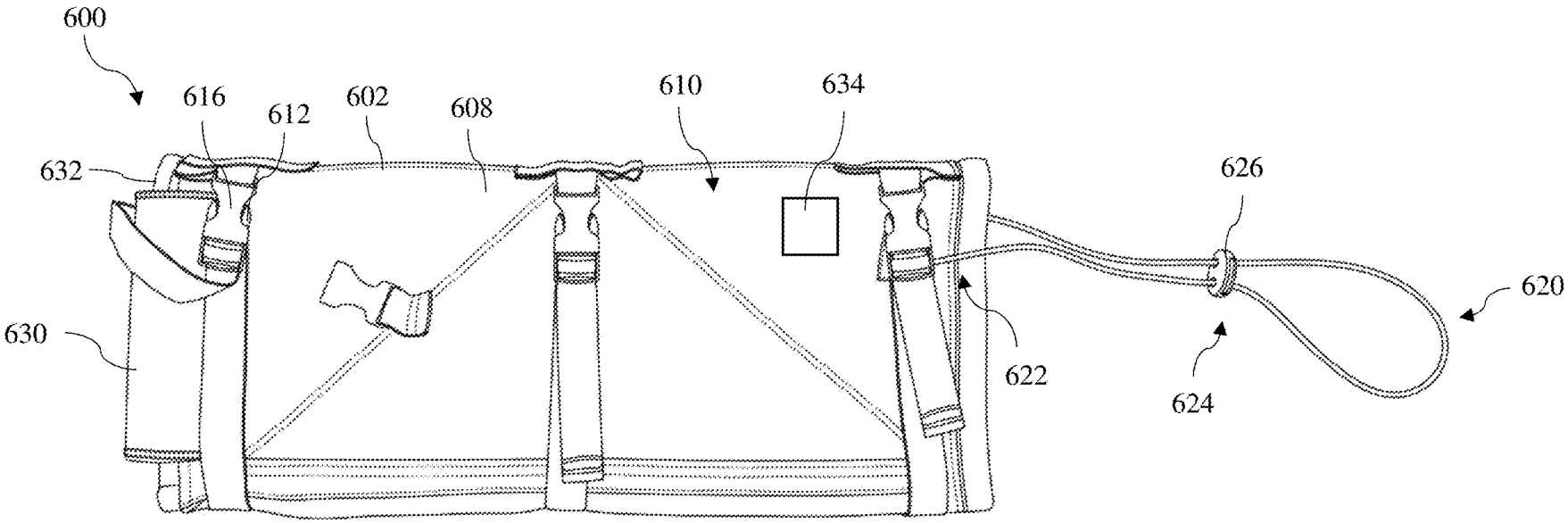
FIG. 6 is a side view of the heat retardant system in the tubular sleeve configuration, according to an example embodiment.
Figure 7:
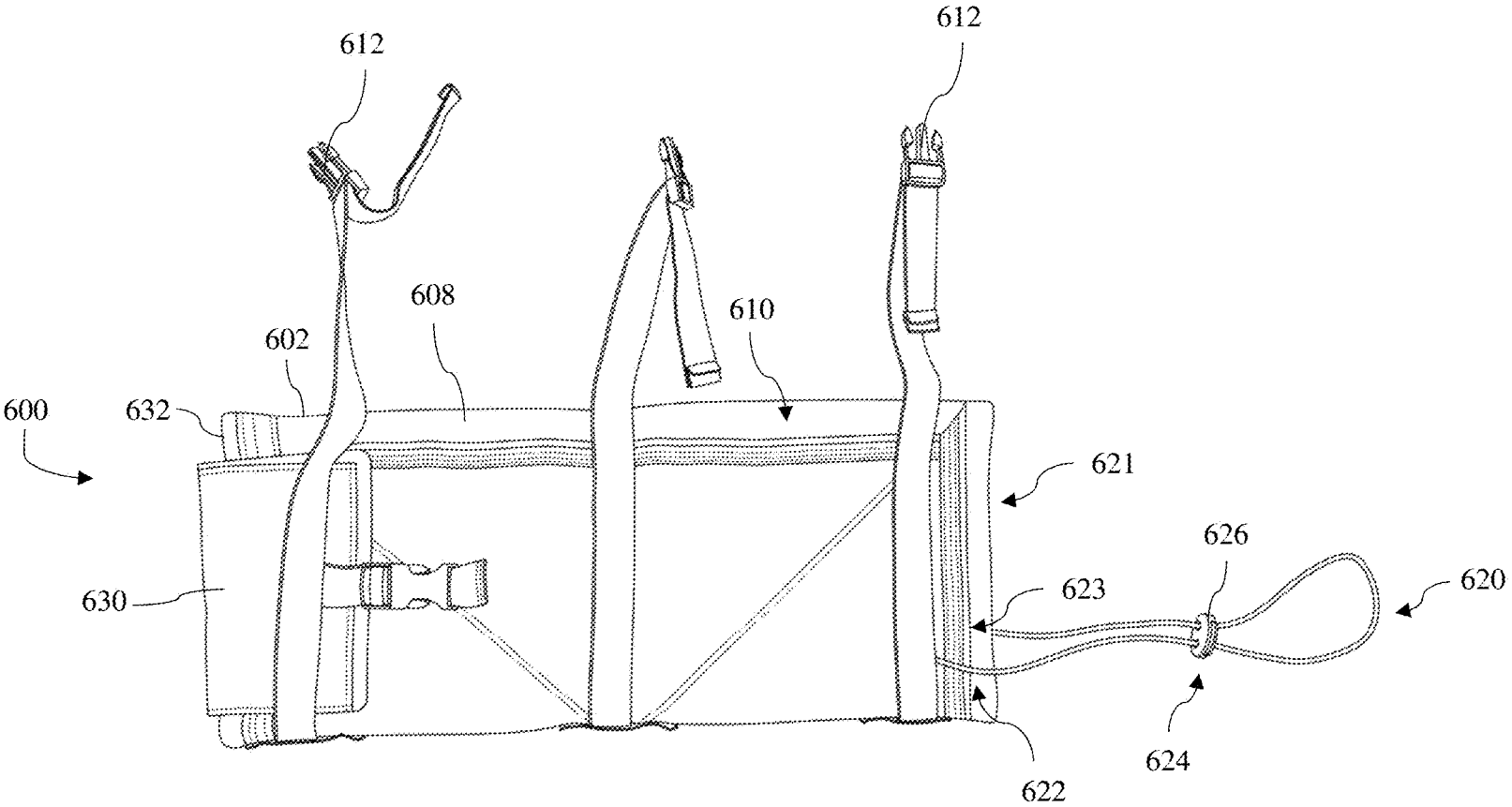
FIG. 7 is a side view of the heat retardant system in the tubular sleeve configuration, according to an example embodiment.
Figure 8:
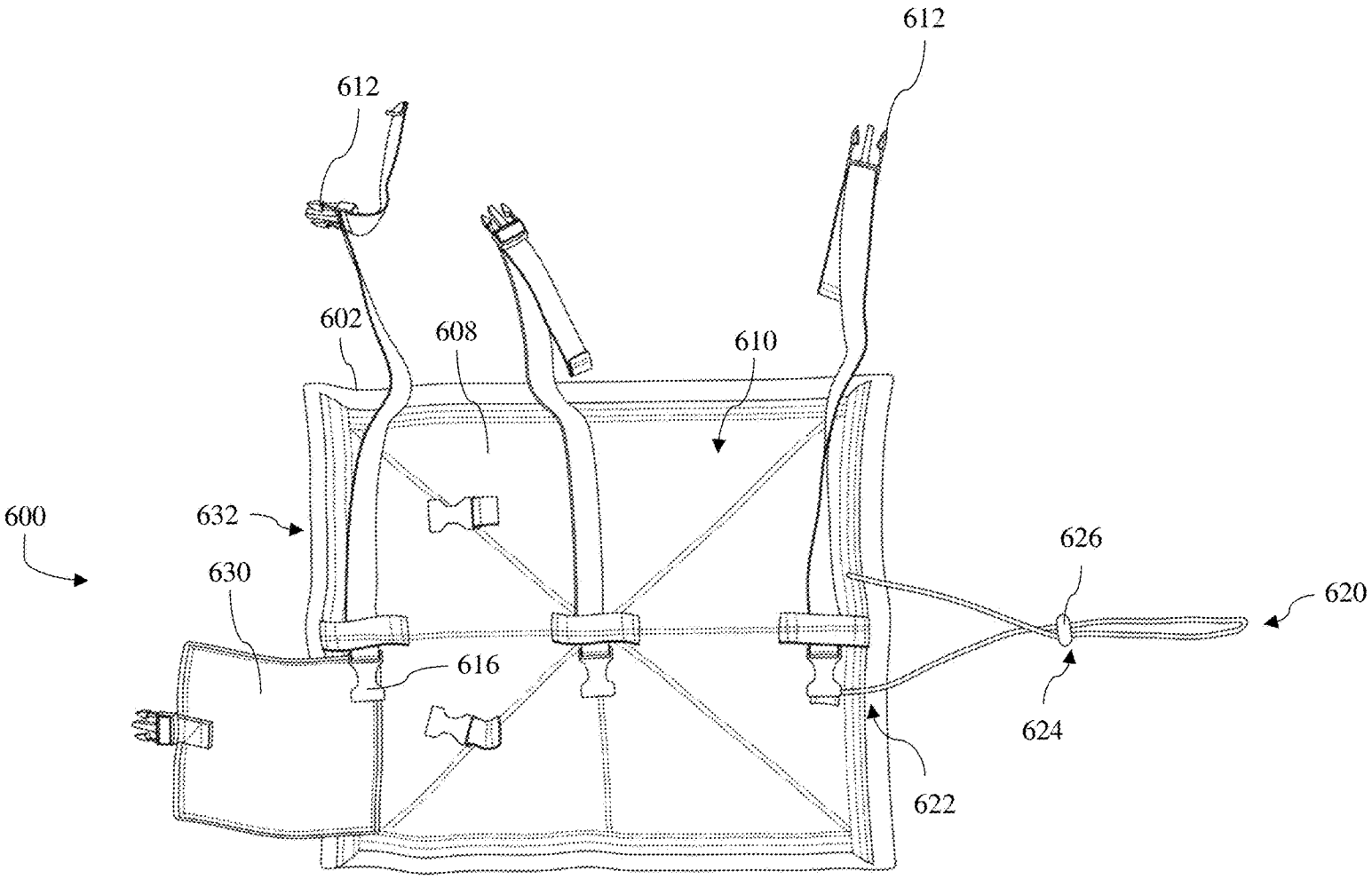
FIG. 8 is a top view of the heat retardant system, according to an example embodiment.
Figure 9:
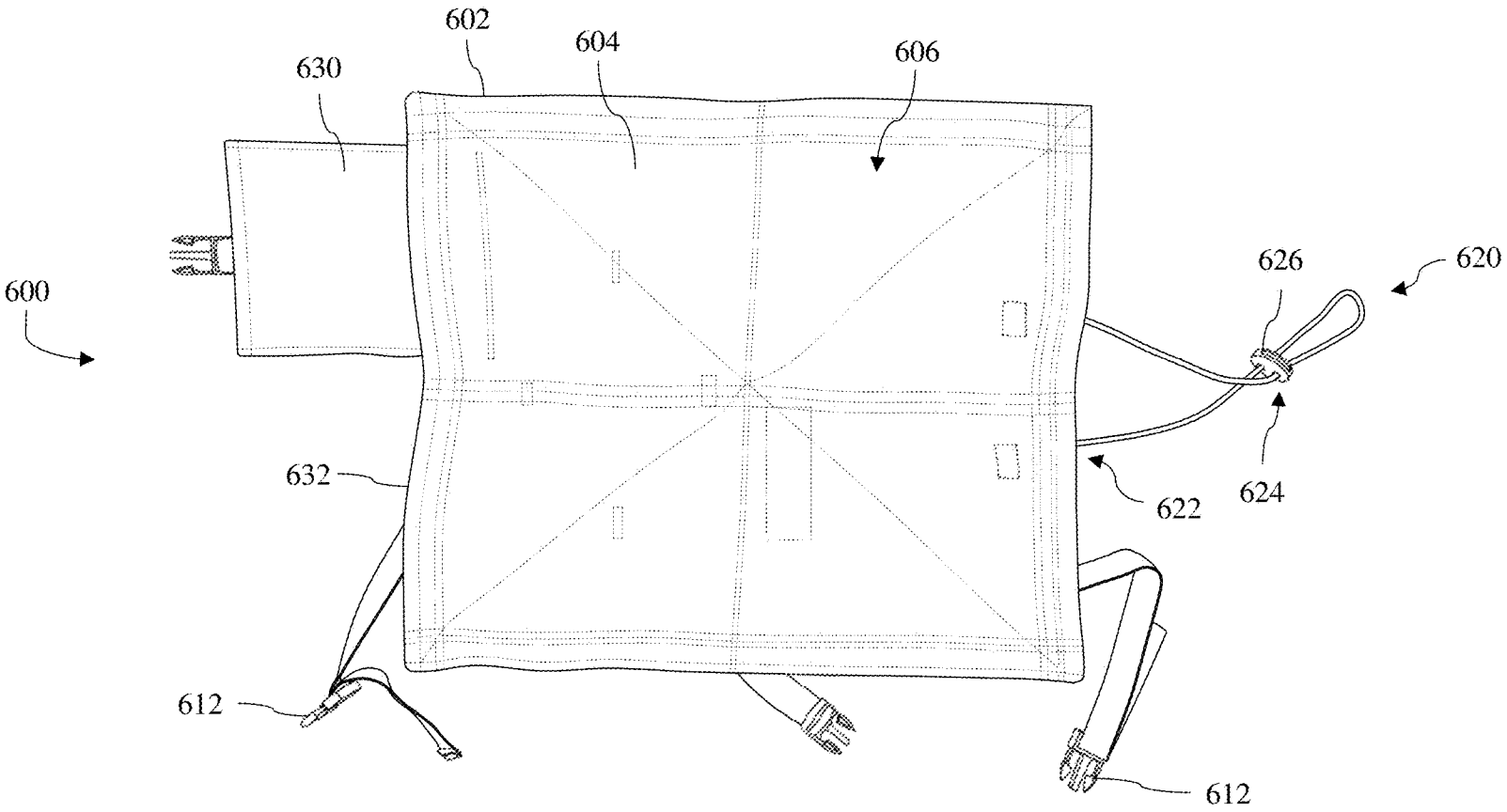
FIG. 9 is a bottom view of the heat retardant system, according to an example embodiment.

The innermost layer 106 of the tubular sleeve provides a heat tolerant material for the barrel of the firearm to be in contact with. The innermost layer of the tubular sleeve defines a retardant channel 120 that extends through the tubular sleeve for substantially covering the barrel of the firearm. In the present embodiments, as shown in FIGS. 5, the flame-retardant material is a carbon-fiber based felt. However, in other embodiments, the material used on the innermost layer 106 of the tubular sleeve may include heat tolerant materials that can withstand temperatures up to 1800 degrees Fahrenheit which may include ceramic fibers, refractory metals such as tungsten and molybdenum, and some high-temperature alloys such as Inconel® and Haynes®. Other materials such as graphite and carbon-carbon composites, such as carbon felt may be used as they can also withstand said high temperatures. As the temperature resistance of the inner material increases, the inner material may become more brittle and/or susceptible to cracking or breaking under stress. Thus, it is important that the outer material is used to reinforce the tubular sleeve and provide a protective layer to the tubular sleeve. This increases the durability of the tubular sleeve. In certain embodiments, the inner material may be detachable from the outer material such that the inner material can be replaced in the event that the inner material is damaged or compromised as to its effectiveness.

Any and all materials may also be used and are within the spirit and the scope of the present invention. The retardant channel 120 may be defined as a conduit or pathway that can withstand high temperatures and prevent the spread of fire. In addition to the flame-retardant material, the channel may be coated with fire-resistant chemicals such as halogenated coatings, phosphorous-based coatings, nano-coatings, etc. Because the fire-retardant channel 120 is used as protection and contains an open inlet and outlet, being the first end portion 102 and second end portion 104, the channel may direct the heat towards either end. As mentioned above, the outermost layer 108 of the tubular sleeve is attached to the innermost layer 106 of the tubular sleeve. The outermost layer 108 of the tubular sleeve, shown in FIG. 3 and FIG. 4, may be comprised of identical or similar materials such as canvas or carbon-fiber based felt. Both the innermost layer 106 and outermost layer 108 consist of a heat tolerant material defined as any material having properties preventing the material from burning or scorching at temperatures of less than 1800 degrees Fahrenheit (975.6 degrees Celsius). As mentioned above, the prior art lacks a firearm cover able to withstand temperatures of this magnitude, therefore the need for a system such as this is great for rapid firing and other firearm uses and quick storage.

The sleeve includes a first opening 112 at the first end portion 102 of the sleeve for receiving a muzzle 121 and/or suppressor of the firearm. The size and shape of the first opening 112 may vary depending on the size or shape of the muzzle or suppressor of the firearm. Generally, the muzzle of a firearm has a circular or oval shape that matches the diameter of the barrel. The size of the muzzle also depends on the caliber or gauge of the firearm. The second opening 114 is at the second end portion 104 of the sleeve, allowing heat to dissipate from the barrel 122. The heat transfers through the second opening as well as the plurality of vents 130 around the tubular sleeve. Each vent of the plurality of vents should be about 3 inches in length, vertically oriented about the latitudinal (or short) axis of the tubular sleeve. The number of vents about the tubular sleeve may vary depending on the length of the sleeve. Generally, in embodiments having a plurality of vents, there is at least three vents, evenly spaced, on each side of the tubular sleeve to allow heat to evenly dissipate.

Having both ends of the sleeve open is critical to the functionality of the sleeve as a firearm cover. The first opening at the first end portion of the sleeve is designed to receive the muzzle and/or suppressor of the firearm. Without this opening, it would be difficult to fit the sleeve over the barrel of the firearm. The second opening at the second end portion of the sleeve is equally important, as it allows heat to dissipate from the barrel. If this opening were not present, heat would become trapped within the sleeve, which could potentially cause damage to the firearm or even create a safety hazard. Additionally, the dual openings provide flexibility for the user in terms of how they position the sleeve on the firearm. For example, if the user prefers to have the muzzle facing downward, they can position the sleeve accordingly. Overall, having both ends of the sleeve open allows for easier use and greater safety, making it a critical aspect of the invention.

One significant advantage of having two open sides on the tubular sleeve is that it can remain on the barrel of the firearm during or after firing. With both ends open, the sleeve does not restrict the airflow or the direction of the heat generated during firing, which can contribute to better accuracy and faster follow-up shots. In addition, the open design allows the operator to easily check the status of the firearm or perform maintenance without the need to remove the sleeve. This not only saves time but also ensures that the firearm is protected from heat damage throughout the entire firing process. The two open sides also make it easy to slide the sleeve on and off the barrel, which can be beneficial in situations where time is critical, such as in law enforcement or military operations.

In certain embodiments, the tubular sleeve may also include additional vents 130 for improved heat dissipation. These vents may be designed to allow the heat to escape through the sleeve while also preventing any potential buildup of pressure. In one embodiment, the vents may extend through the outermost layer material of the sleeve, while in other embodiments, they may extend through both the innermost layer and outermost layer materials. The size and shape of the vents may vary depending on the desired level of heat dissipation and the specific firearm for which the sleeve is designed. By providing these additional vents, the sleeve can better regulate the temperature of the firearm, thus reducing the risk of overheating and damage.

Figure 1B:
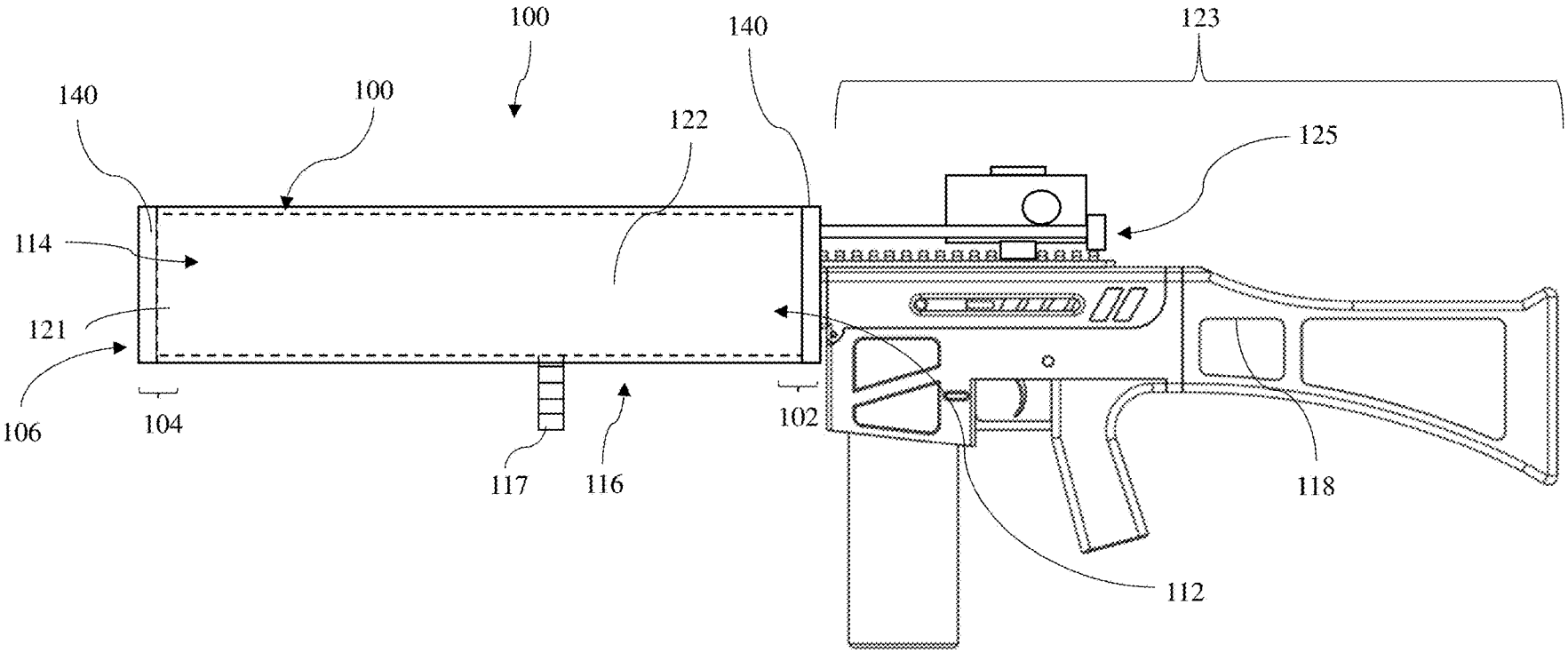
FIG. 1B is a side view of the tubular sleeve substantially covering a barrel of a firearm, according to a second example embodiment.
Figure 2:
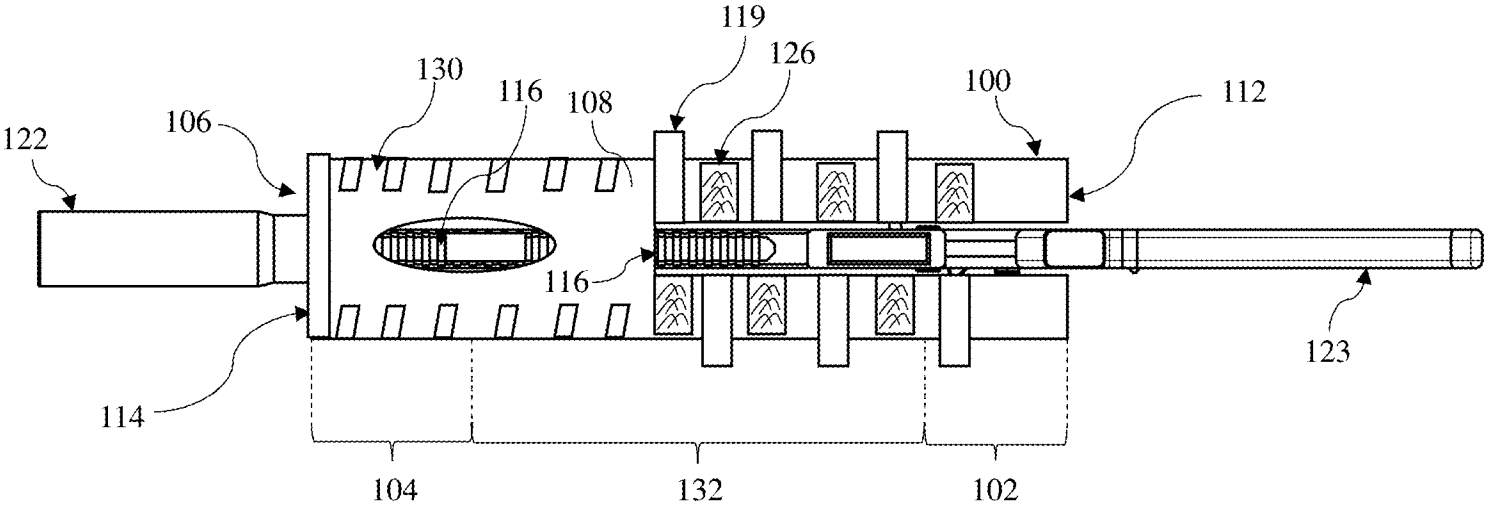
FIG. 2 is a bottom view of the tubular sleeve substantially covering a barrel of a firearm, according to an example embodiment.
Figure 3:
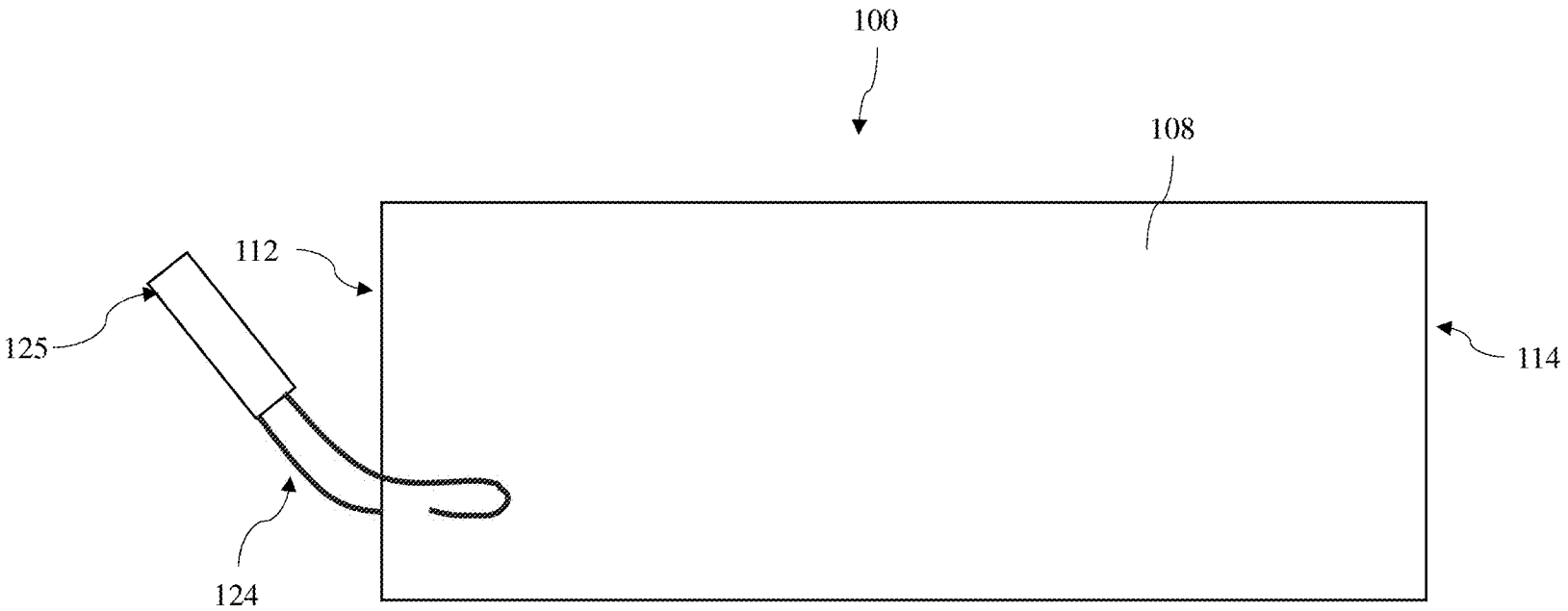
FIG. 3 is a side view of the tubular sleeve including an elastic fastener, according to an example embodiment.
Figure 4:
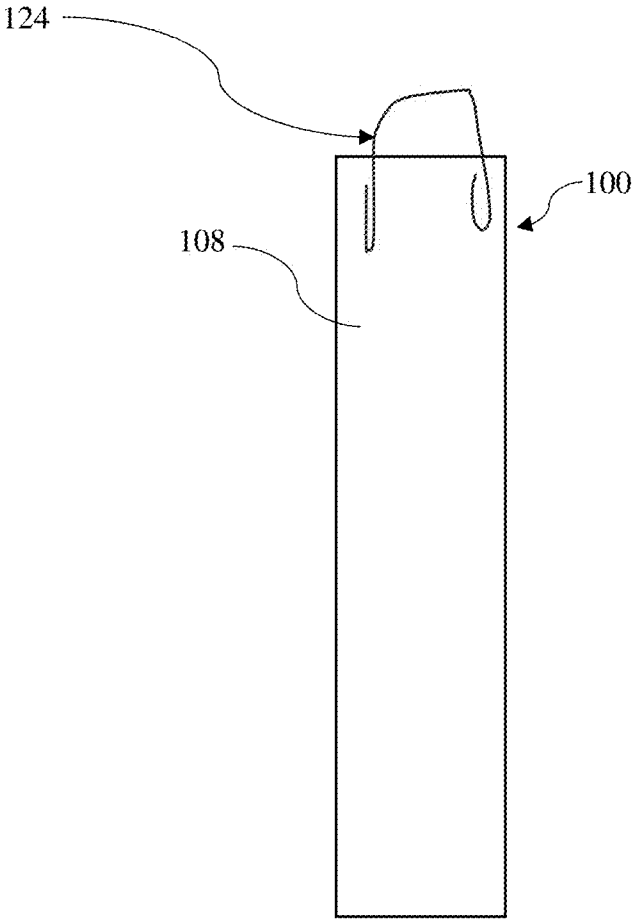
FIG. 4 is a top view of the tubular sleeve including an elastic fastener, according to an example embodiment.

The fastener 118 is a device or mechanism used to secure the tubular sleeve to a rearward portion 123 of a firearm, as shown in FIG. 1B. The fastener may include various components, such as cords, straps, hooks, loops, buckles, or other attachment mechanisms, depending on the specific embodiment. Its primary function is to hold the sleeve firmly in place on the firearm, preventing it from slipping or sliding during use or transport. The fastener is attached the first end portion 102 of the sleeve and is configured for securing to a rearward portion 123 of a firearm which includes any portion of the firearm before the barrel, including but not limited to, as the upper receiver, optic, sock, and/or lower receiver. In certain embodiments, it is optimal to secure the fastener to the optic of the firearm as it is generally a consistent point of securing the device across different types of firearms.

In certain embodiments, the fastener 118 includes a flexible and elastic cord 124 having each terminating end coupled to the tubular sleeve and a center pad 125 attached to the cord for providing a protective layer at the point of contact with the rearward portion 123 of the firearm. The elastic cord 124 may be defined and described as a flexible cord made of rubber or another elastic material that can stretch and return to its original shape. Elastic cords typically have a core of one or more elastic strands, which may be covered in a woven or knitted sheath made of a material such as cotton, nylon, or polyester.

The use of an elastic cord as a fastener provides several critical benefits and improvements over the prior art. The elastic cord allows for quick and easy attachment and removal of the sleeve from the firearm, without requiring the use of tools or additional fastening mechanisms. The elastic cord can stretch to accommodate various sizes and shapes of firearms and can provide a snug and secure fit. Additionally, the center pad attached to the cord provides a protective layer at the point of contact with the rearward portion of the firearm, preventing any potential damage or scratching, and helps to prevent the elastic cord from slipping off of the firearm.

The sheath provides additional strength and durability to the cord and also helps to prevent the elastic cord(s) from becoming twisted or tangled. The thickness and length of the elastic cord 124 may vary depending on the desired tension and strength. The purpose of the elastic cord is to secure the sleeve onto the barrel of the firearm. The elastic cord stretches towards the rear of the firearm, attaching at the butt of the firearm. When in transport, the sleeve protects any and all items or personnel from the heat radiating from the gun's barrel. Overall, the disclosed heat retardant system provides an effective and practical solution for protecting a firearm barrel from heat damage and extending the lifetime of the firearm, thereby reducing the need for costly repairs and replacements.

The center pad 125 attaches to the elastic cord 124 to provide a protective layer at the point of contact with the rearward portion 123 of the firearm. The center pad may be made from materials such as nylon, leather, neoprene, polyester, canvas, etc. The center pad may be attached to the elastic cord using adhesives such as glue, hook and loop elements, snaps, buttons, ties, etc. The size and shape of the center pad may vary. For example, in one embodiment, the center pad may take the shape of the rearward end of the firearm such that the center pad cups the stock. In other embodiments, the center pad may be a single rectangular strap fit snug around the stock or rear portion of the firearm. In further embodiments, the center pad may be stitched to or affixed to the elastic cord. In other embodiments, the center pad may define a portion of the cord being a different material than the cord.

In various embodiments, the fastener 118 can be attached to the outer material of the tubular sleeve or between the outer material and the inner material. Openings allowing the fastener to be attached between the materials may be grommeted. The means of attachment can include adhesives, stitching, hook and loop elements, snaps, buttons, ties, or other attachment mechanisms. It is important to note that the fastener should not be exposed within the retardant channel to prevent the accumulation of any unwanted materials that could compromise the integrity of the heat retardant system. In some embodiments, an exposed fastener could potentially scratch or damage the firearm or become tangled with other gear during transport. Therefore, ensuring the fastener is properly and securely attached without being exposed within the retardant channel is critical for the effectiveness and longevity of the heat retardant system. If the fastener is exposed within the retardant channel and is not made from a heat-resistant material, it may pose a risk of ignition or damage to the device. Additionally, an exposed fastener may interfere with the ability of the sleeve to slide smoothly over the barrel of the firearm, which could compromise its effectiveness in protecting the firearm from heat damage. To avoid these issues, the fastener can be attached to the outer material of the sleeve or between the outer and inner materials, ensuring that it is not exposed within the retardant channel and that it is made from a heat-resistant material. In other embodiments, where the fastener must be secured to the tubular sleeve such that it is exposed within the retardant channel, then to maintain the heat-resistant properties of the tubular sleeve, it is important that the fastener and any attachments be made from heat-resistant materials.

The system may include a rigid section 131 on one of the top portion or bottom portion of the tubular sleeve and extending the length of the tubular sleeve for maintaining the tubular sleeve in an upright position. The rigid section 131 may be defined and described as a material that is resistant to bending or deformation under stress, such as plastic, metal, carbon fiber, rubber, or any other suitable material. The rigid section may be used as a grip for sliding the sleeve onto the firearm, as well as a guide or indicator when sliding the sleeve onto the firearm. This section may act as an alignment or center weight for orienting the sleeve in the desired position or arrangement. Additionally, the sleeve may include a rigid section about the edges of the sleeve and/or where there is exposed stitching, such as the portion of the sleeve where the innermost layer material is wrapped about the outermost layer material and/or around a cutout of the sleeve.

Furthermore, a side or portion of the tubular sleeve includes a cutout 116 extending at least partially the length of the sleeve. The cutout may be defined and described as an opening or hole in the tubular sleeve for receiving one of an optic, an iron sight, or an attachment to the firearm such as a flashlight or slanted foregrip. The cutout 116 may be located, for example, on a bottom facing portion or side of the sleeve, extending from a middle portion 132 of the sleeve to the first end portion 102 of the sleeve, for sliding over a vertical or angled foregrip 117 attached to the barrel 122 of the firearm. For attachments that are mounted to the side of the firearm, the cutout may be about the side of the tubular sleeve to align with the attachment. Additionally, the sleeve may include more than one cutout in certain embodiments.

The size and shape of the cutout may vary depending on the particular attachment being used. For example, a firearm's foregrip, also known as a vertical foregrip or angled foregrip, may be cylindrically shaped, having a diameter sized to allow a shooter's hand to wrap around it comfortably. The foregrip may be screwed onto the front of the weapon or attached using a quick-detach mechanism. In some embodiments, the cutout may be a hole or gap in the sleeve which the attachment will fit within, while in other embodiments, it may be a narrow slit in the sleeve extending to the end of the sleeve for allowing the user to easily slide the sleeve over the barrel and around the attachment.

In other embodiments, the cutout 116 may include attaching elements 119 located on the outermost layer 108 of the sleeves. These attaching elements may be used for additional security ensuring the sleeve remains snug on the firearm. As seen in the present embodiment, FIG. 2, there are a plurality of attaching elements linearly arranged to each other, and adjacent to the elongated cutout. The present attaching elements are shown to be hook and loop elements, having the hook side 126 aligned with the loop side, and fully attached to the outermost layer of the sleeve. The hook and loop elements are alternating thereby providing a gap between adjacent elements on the same side. This allows for variability in the cutout to allow the tubular sleeve to secure around the attachment. The hook and loop elements provide the cutout of tubular sleeve with threshold to ensure that the tubular sleeve fits around the attachment to the barrel, namely, the underside barrel attachment which is secured to the rail of the handguard of the firearm. The looped side may be partially attached to the sleeve allowing the operator to fold the loop side over the cutout and secure it onto the hook side. In other embodiments, the attaching elements may be in the form of a buckle, snap fasteners, buttons, zippers, etc. Other means to provide a variable-sized cutout are within the sprit and scope of the present invention. Additionally, the plurality of attaching elements, such as hook and loop straps 119 and 126, may be made out of a fire resistant/heat resistant material consistent with this disclosure. It is understood that, in certain embodiments, the hook and loop strap attaching elements may extend the entire length of the underside of the tubular sleeve.

The attaching elements of the cutout around the tubular sleeve allows the operator to tighten the sleeve securely around attachments on the firearm using attaching elements, thereby promoting minimal movement or sliding on the sleeve. For instance, an operator may have an extended magazine attached to the bottom of the firearm. By using the attaching elements, the operator can tighten the sleeve securely around the magazine. Similarly, in another embodiment, an operator may have an angled foregrip attached near or on the bottom side of the barrel. The attaching elements available around the cutout allow the operator to tighten the fasteners snugly around the foregrip, insulating the heat from the barrel, and further protecting the operator's hand while using the foregrip.

The sleeve described in this invention is designed to be easily slidable over the barrel of a firearm, providing a level of convenience and ease of use that is lacking in the prior art. The tubular sleeve's ability to slide refers to its ability to freely slide or move along the barrel of the firearm until it is fastened to the rear portion of the firearm. Unlike other firearm covers that may require additional tools or equipment to install, the tubular sleeve can be quickly and easily slipped onto the barrel by the operator. This design makes it particularly useful for rapid firing and other firearm uses where time is of the essence. Additionally, the sleeve can be secured onto the firearm with the fastener, ensuring that it stays in place and providing protection for the operator from the heat radiating from the barrel. This easy slide feature is a significant improvement over the prior art, where firearm covers may require complicated installation processes that could potentially slow down the operator and hinder their performance.

Referring now to FIGS. 6 through 9, the heat retardant system 600 for covering a barrel of a firearm will be described in another example embodiment. FIGS. 6 through 9 illustrate the heat retardant system including a planar body. The system is based on a planar body 602 that, when configured, forms a substantially tubular sleeve enveloping the firearm's barrel. This adaptive configuration is designed to provide heat resistance and physical protection, significantly reducing the heat transfer from the barrel to the user and surrounding environment. The planar body includes a heat resistant layer 604 on the bottom side 606 and an outermost layer 608 on the top side 610, providing additional insulation and environmental protection. The heat resistant layer directly contacts the barrel when in the sleeve configuration, made of materials capable of withstanding high temperatures. In some embodiments, an intermediate padding layer may be included between the heat resistant and outermost layers to enhance thermal insulation and shock absorption. In its operational configuration, the planar body's heat resistant layer forms the innermost layer of the tubular sleeve, effectively managing the heat emanating from the barrel. The system 600 further includes a first fastener 612 and a second fastener 616 configured to removably mate with the first fastener. The first and second fasteners on opposite longitudinal sides of the planar body facilitate the transformation into the tubular configuration. A third fastening mechanism 620 extends from the planar body to attach removably to the rearward portion of the firearm, ensuring the system remains securely positioned during use. These fasteners secure the sleeve to the firearm.

The system includes a substantially tubular sleeve configuration in which the first fastener mated with the second fastener. The heat resistant layer 104 on the bottom side 106 of the planar body forms an innermost later of the substantially tubular sleeve configuration. The substantially tubular sleeve configuration includes a barrel channel 621 that is configured to receive the barrel of the firearm. The system further includes an operational configuration, in which the heat retardant system in the substantially tubular sleeve configuration substantially envelopes at least a portion of the barrel of the firearm. The third fastening mechanism 620 is configured to extend rearwardly from the lateral side portion 623 of the planar body to the rearward portion of the firearm.

The planar body 602 serves as the foundational component of the heat retardant system. It is essentially a flat structure that can be configured into a tubular sleeve to envelop the barrel of the firearm. This versatility in form factor allows it to adapt to different firearm designs and sizes. The planar body is detailed to comprise a heat resistant layer on the bottom side, which directly interfaces with the barrel when in the operational tubular configuration. The top side of the planar body features an outermost layer that is exposed to the external environment, providing additional insulation and protection. When configured into the tubular sleeve, the planar body wraps around the barrel, with its heat resistant layer forming the innermost layer of the sleeve. This configuration ensures that the barrel is substantially enveloped, optimizing heat management by utilizing the material properties of the heat resistant layer. Fasteners positioned along the longitudinal sides of the planar body, as well as an additional third fastening mechanism, secure the system to the firearm, ensuring stability and ease of use.

The third fastening mechanism 620 is an adjustable and detachable component of the heat retardant system, designed to extend from the lateral side of the planar body to the rearward portion of the firearm. This fastener ensures that the system remains securely attached to the firearm, accommodating various firearm designs and operational dynamics. The first end 622 is securely attached or integrated into the lateral side portion of the planar body. This placement allows the fastener to support the planar body when it wraps around the barrel, maintaining the system's structural integrity and positioning. The second end 624 features an attachment mechanism 626 that enables quick and secure attachment to and detachment from the rearward portion of the firearm. This end could include toggle ties (shown in the present embodiment), hooks, clasps, snaps, or Velcro, depending on the specific requirements for compatibility with different firearm models.

The planar body may include an extended portion or flap 630 attached to a lateral side portion 632, which can be configured to at least partially enclose the second opening. The extended portion covers the muzzle but maintains some open access to allow heat to dissipate. This extended portion acts as an adaptable segment of the tubular sleeve that can extend or retract to cover or uncover the second opening at the end of the sleeve, which is generally situated around the muzzle of the firearm. This feature allows for flexible coverage based on operational needs, providing heat management while accommodating different firing conditions. The extended portion or flap is typically made from the same or similar materials as the main body of the tubular sleeve, ensuring consistent properties of heat resistance and durability. It is designed to overlap or fit around the muzzle end of the barrel, offering partial coverage that can be adjusted to increase or decrease the opening area. This adjustability allows for controlling the amount of heat dissipation and muzzle exposure to the environment. In the operational configuration, the extended portion functions to balance the need for heat dissipation with protection from external elements. By partially enclosing the second opening, it helps to retain some of the heat within the sleeve, which can be beneficial in cold weather conditions or in situations where too rapid cooling of the barrel might affect firing accuracy or mechanical integrity. Conversely, it allows for sufficient openness to enable heat to escape efficiently during or after high-rate firing or in hot conditions, preventing overheating.

In some embodiments, a temperature reactive indicator 634 is disposed on the outermost layer to indicate a heat status of the barrel of the firearm. The temperature reactive indicator is a visual or tactile element incorporated into the outermost layer of the heat retardant system. Its primary function is to change its properties in response to the heat emanating from the barrel, thereby providing an immediate indication of the temperature level. This indicator can be implemented in various forms, such as thermochromic (color-changing) materials, liquid crystals, or electronic sensors that change appearance or emit signals based on the temperature. The choice of indicator type depends on the desired visibility, accuracy, and response time. Thermochromic materials, for example, might change color at specific temperature thresholds, offering a clear visual cue that can be easily interpreted even under stressful or rapid operational conditions. Positioned on the outermost layer, the temperature reactive indicator is strategically placed to detect and respond to the heat passing through the inner layers of the system. As the barrel heats up, the heat dissipates outward through the system's layers, reaching the outermost layer and affecting the temperature indicator. The indicator then reacts according to its design—changing color, activating an electronic display, or altering its texture—to signal the current heat status.

In some embodiments, the system 600 may include a rigid stabilizer on the top side of the planar body that extends longitudinally on the planar body when in the substantially tubular sleeve configuration. The rigid stabilizer is similar to the rigid section 131 shown in FIG. 1A. The rigid stabilizer is a longitudinal component located on the top side of the planar body. Its primary function is to maintain the structural integrity and shape of the planar body, particularly when it is formed into the tubular sleeve configuration around the firearm's barrel. This stabilizer extends along the length of the planar body, aligning with its longitudinal axis. In the tubular sleeve configuration, the stabilizer likely faces outward, positioned opposite to the barrel, ensuring that the sleeve maintains a uniform shape and does not collapse or twist under its own weight or when subjected to external forces. Within the heat retardant system, the rigid stabilizer supports the tubular configuration. It aids in preserving the cylindrical shape of the sleeve, ensuring that the heat resistant layer inside remains evenly distributed and fully functional in its role of heat management. The stabilizer prevents the material from sagging or bunching, which could compromise the system's effectiveness and durability.

In some embodiments, the system 600 a plurality of vents about the planar body, the plurality of vents extending through the outermost layer of the planar body to the heat resistant layer. The vents are strategically placed openings within the planar body of the heat retardant system, extending from the outermost layer through to the heat resistant layer. These vents are designed to facilitate the flow of air and the expulsion of heat from around the barrel, improving the cooling efficiency of the system. Positioned throughout the planar body, these vents are typically evenly distributed to maximize area coverage and ensure uniform heat dissipation. Their design allows for the passage of air but is small enough to maintain the structural integrity and protective capabilities of the layers. The vents can vary in shape—such as circular, slotted, or a series of small perforations—depending on the specific thermal management needs and the manufacturing capabilities. Within the heat retardant system, the vents enhance thermal regulation. By allowing hot air to escape and cooler air to enter, the vents prevent heat buildup directly on the barrel's surface. This interaction not only protects the firearm from overheating but also reduces the risk of heat transfer to the user, thereby improving both safety and comfort during operation.

In some embodiments, the planar body incorporates at least one cutout or opening designed to accommodate and align with specific components or attachments on the firearm. The cutouts or openings are important for ensuring that the heat retardant system fits securely and functions effectively when wrapped around the barrel and associated firearm attachments. The cutout is a strategically placed gap or recess that allows the planar body to be fitted over protruding parts of the firearm, such as sights, mounts, or rails. The cutout ensures that the system does not obstruct or interfere with these elements, providing a snug and unobtrusive fit. Similar to the cutout, the opening serves the purpose of aligning the system with specific firearm components. However, an opening can also function as an entry point for the barrel or other parts, facilitating ease of installation and removal. Openings might be designed as slits, holes, or larger gaps, depending on the requirement. Both the cutout and the opening enhance the adaptability and usability of the heat retardant system. They allow the planar body to be configured accurately and securely around the firearm's unique contours and attachments, maintaining the system's position during operation. This ensures that the heat retardant properties are effectively utilized without hindrance to the firearm's functionality or accessibility.

Figure 10:
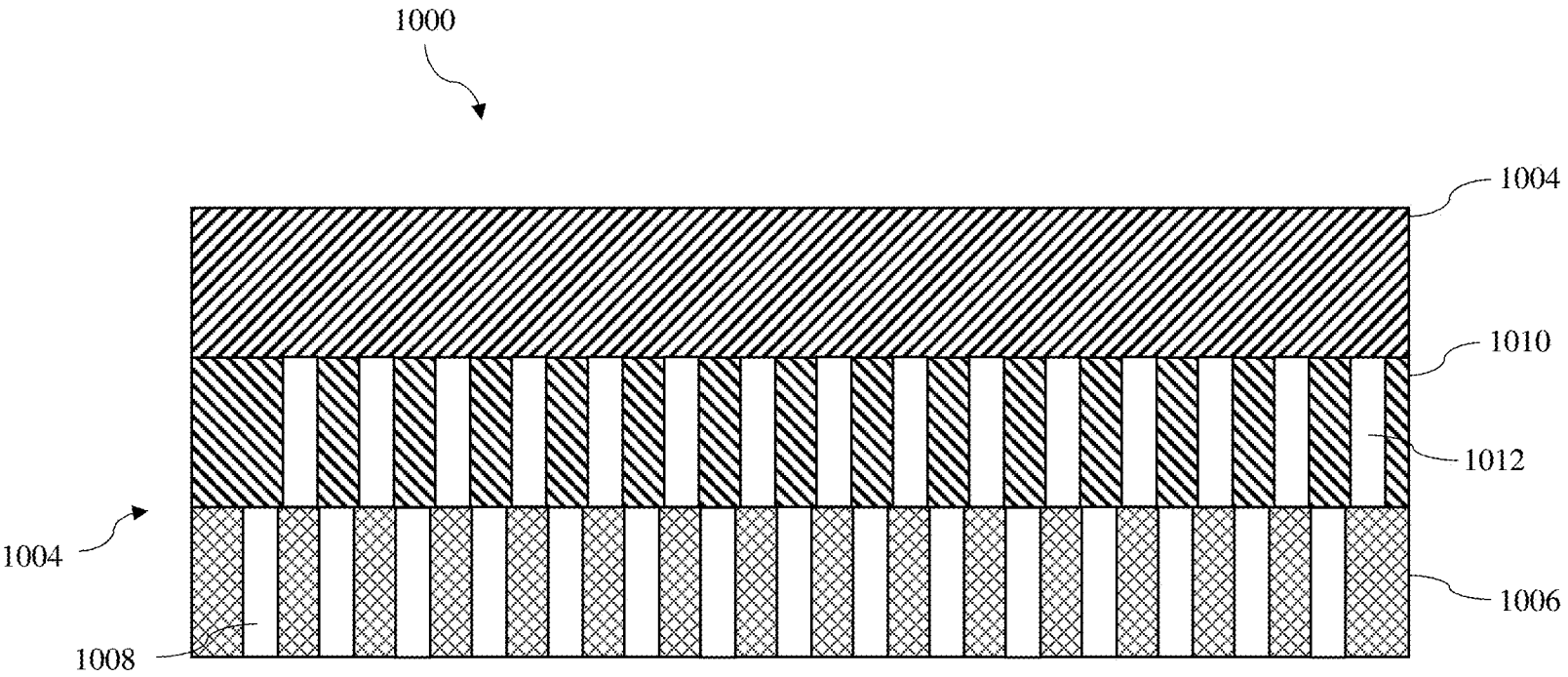
FIG. 10 is a cross-sectional side view of the planar body, according to an example embodiment.

Referring now to FIG. 10, a cross-section of a side view of the planar body 1000 is illustrated, according to an example embodiment. The heat resistant layer on the bottom side 1004 of the planar body includes a first heat resistant layer 1006 including a first plurality of apertures 1008 and a second heat resistant layer 1010 including a second plurality of apertures 1012. The second heat resistant layer is offset relative to the first heat resistant layer such that the first plurality of apertures of the first heat resistant layer are substantially occluded by the second heat resistant layer.

The first heat resistant layer is the primary heat-resistant component of the planar body, designed to be in direct contact or proximity to the firearm's barrel when the system is in operational mode. The inclusion of apertures—small openings or perforations—within this layer is intended to facilitate heat management through increased air circulation and thermal regulation. The apertures in the first heat resistant layer are systematically arranged to create a pattern that maximizes heat dissipation without compromising the structural integrity or protective function of the layer. These apertures allow for the escape of heat directly from the surface of the barrel, while also enabling cooler air to flow into the system, thus helping to maintain a stable temperature around the firearm's barrel. The first heat resistant layer with its apertures interacts with other components of the system by providing a first line of defense against heat. It works in conjunction with other layers, possibly including additional insulating or padding layers, to enhance overall heat resistance. The airflow facilitated by the apertures not only cools the barrel but also helps to distribute the thermal energy more evenly across the system, reducing hotspots that could lead to discomfort or damage during use.

The second heat resistant layer is positioned adjacent to or above the first heat resistant layer, designed to further mitigate heat transfer from the firearm's barrel. The second plurality of apertures in this layer enhances the system's overall effectiveness at dissipating heat. The apertures in the second heat resistant layer are typically aligned or staggered relative to those in the first layer. This arrangement can create a path for heat to escape more efficiently while minimizing direct thermal pathways, thereby providing enhanced thermal protection. The design and placement of these apertures are critical for optimizing airflow and maximizing heat dissipation without reducing the structural integrity of the system. The second layer with its apertures works in tandem with the first layer to control and reduce the heat exposure significantly. By having staggered or offset apertures relative to the first layer, it ensures that the direct transfer of heat is minimized, creating a more effective barrier against heat propagation. This setup allows for a more gradual and controlled escape of heat, utilizing convection effectively to cool the barrel.

Figure 11B:
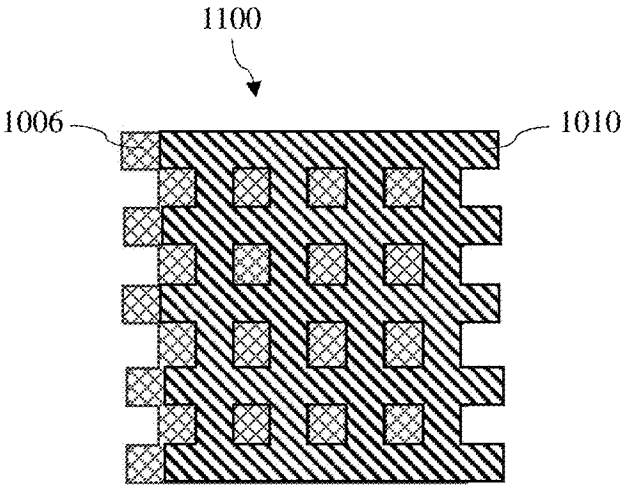
FIG. 11B is a cross-sectional top view of the heat resistant layer, according to an example embodiment.
Figure 11A:
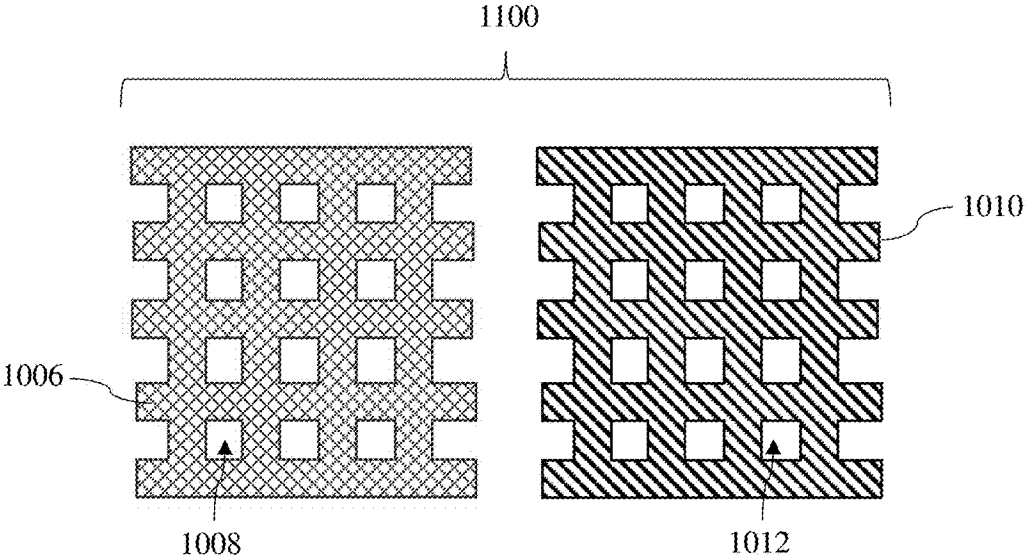
FIG. 11A is an exploded cross-sectional top view of the heat resistant layer, according to an example embodiment.

Referring now to FIGS. 11A and 11B, a cross-section of a top view of the heat resistant layer 1100 is shown, according to an example embodiment. The offset arrangement of the heat resistant layers 1006, 1010 involves strategically positioning the second heat resistant layer 1010 so that the second apertures 1012 do not align directly with the first apertures 1008 of the first heat resistant layer 1006. Instead, the apertures of the second layer cover or overlap the apertures of the first layer, effectively blocking a direct path of heat transfer through the first layer's apertures. The apertures in the second layer are placed such that they are staggered or misaligned relative to those in the first layer. This configuration creates a labyrinthine path for heat and air, forcing the heat to take a more circuitous route to escape, which significantly slows down the heat transfer and increases the cooling time. By occluding the apertures of the first layer, the second layer maximizes the effectiveness of thermal management. As heat rises through the apertures of the first layer, it encounters the material of the second layer, which absorbs some of the heat before it can escape. The remaining heat must navigate towards and through the second layer's apertures, which are not directly aligned, thus undergoing further cooling before being released from the system. This setup enhances the overall insulation properties of the system by adding depth and complexity to the barrier against heat.

The heat resistant layers are capable of withstanding temperatures ranging up to 1800 degrees Fahrenheit. The primary function of the heat resistant layer is to absorb and dissipate the intense heat generated during firing, allowing for safe storage of the firearm. Such a high temperature threshold ensures that the layer can handle the extreme heat produced by rapid or sustained firing sequences without degrading in integrity or performance. In the operational configuration, the heat resistant layer acts as the first line of defense against heat transfer from the barrel to the outer layers of the system and ultimately to the external environment. Its high temperature tolerance allows it to perform consistently under various firing conditions, maintaining its structural and functional properties without failure.

Figure 12:
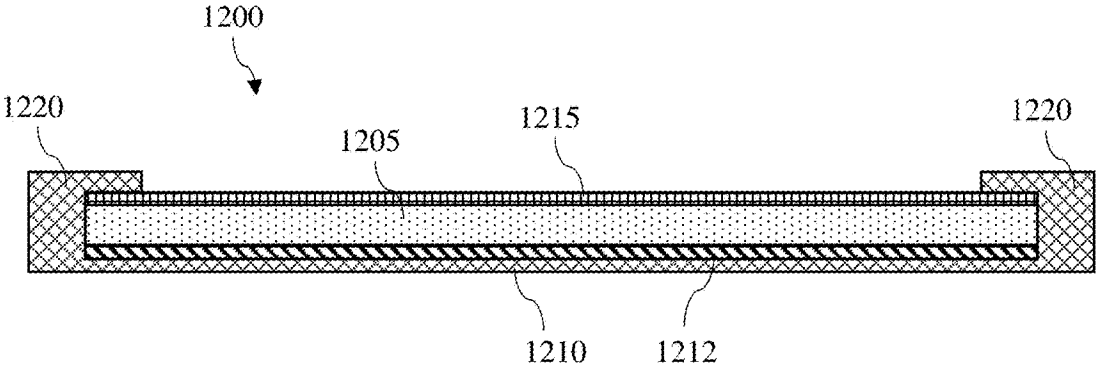
FIG. 12 is a cross-sectional side view of the planar body, according to an example embodiment.

Referring now to FIG. 12, a cross-section of a side view of the planar body 1200 is shown, according to an example embodiment. In this embodiment, a padding layer 1205 is disposed between the heat resistant layers 1210, 1212 and the outermost layer 1215. While the padding layer is optional, the padding layer provides additional thermal insulation and shock absorption. The padding layer serves as an intermediary component within the multi-layer configuration of the heat retardant system. Its primary role is to add an additional level of insulation against heat transfer from the barrel to the outer environment and to absorb vibrations or shocks that occur during firing or storage. This layer is typically made from materials that are both thermally insulative and capable of dissipating kinetic energy from shocks and impacts. The materials used may include foamed polymers, aerogels, or advanced composite materials that combine light weight with high thermal resistance and cushioning properties. The thickness and density of the padding layer are carefully calibrated to maximize insulation without significantly increasing the bulk or weight of the overall system. Positioned between the heat resistant layer, which directly interfaces with the heat source (the barrel), and the outermost layer, which is exposed to the external environment, the padding layer plays an important role. It slows the heat transfer further, ensuring that any heat passing through the heat resistant layer is significantly dampened before reaching the outermost layer. Additionally, the padding layer absorbs mechanical energy from shocks and vibrations resulting from the firing, which helps in maintaining the structural integrity of the system and increasing the comfort for the user by reducing the felt impacts.

The planar body 1200 further includes a perimeter extension 1220 of the heat resistant layer. The perimeter extension wraps around a perimeter edge of the planar body to cover at least a margin of the outermost layer on the top side. The perimeter extension refers to an additional segment of the heat resistant layer that extends beyond its primary boundaries to wrap around the edge of the planar body. This extension covers the perimeter of the planar body, ensuring that the edges, which are often more susceptible to wear and exposure, are adequately protected. This extension overlays at least a margin of the outermost layer on the top side of the planar body. By wrapping around the perimeter edge, it creates a continuous protective barrier that not only enhances thermal insulation but also increases the mechanical integrity of the edges, protecting them from fraying, peeling, or exposure to environmental elements. In the operational configuration of the heat retardant system, the perimeter extension seals the interface between different layers and the external environment. It helps to maintain the positional stability of the layers, ensuring that the heat resistant properties are uniformly effective across the entire surface area in contact with the barrel. Additionally, this design minimizes any gaps that could allow heat to escape or enter, thereby optimizing the system's overall thermal management capabilities.

In this embodiment, the first heat resistant layer 1210 may be made of materials such as carbon felt. Carbon felt is a type of high-temperature insulation material made primarily from carbon or graphite fibers. Carbon felt material is known for its exceptional properties which make it suitable for a variety of demanding applications that require thermal insulation and heat resistance. However, other heat tolerant materials, such as silicon carbide, zirconium oxide, carbon fiber reinforced polymers, ceramic matrix composites, stainless steel alloys, polyimide, polytetrafluoroethylene, silica aerogel, calcium silicate boards, refractory ceramics, phase change materials, etc., may be used and are within the spirit and scope of the present disclosure.

The second heat resistant layer 1212 may be a heat shield configured to protect against radiant and conducted heat from the barrel of the firearm. The heat shield may include materials such as, but not limited to, high-temperature metals, ceramics, composite materials, etc. As a heat shield, the second layer is configured to direct heat away from sensitive areas, to dissipate heat, and to slow the transfer of heat from the barrel to the exterior. This layer is positioned strategically to catch and manage heat passing through the first heat resistant layer.

In some embodiments, the tubular sleeve may include materials that can effectively manage heat up to 1200 degrees Fahrenheit. This temperature tolerance is suitable for hunting rifles, sporting firearms, and some handguns where extreme conditions are less likely. In other embodiments, the tubular sleeve may include materials that can effectively manage heat up to 1500 degrees Fahrenheit. This tolerance is intended for more demanding applications, such as law enforcement or light military use because this tubular sleeve is ideal for higher-capacity rifles and some automatic weapons used in more intense firing scenarios. In other embodiments, the planar body may include materials that can effectively manage heat up to 1800 degrees Fahrenheit. This high-performance tolerance is configured for heavy-duty military applications and situations involving sustained rapid fire. A tubular sleeve with this tolerance is suitable for military-grade automatic weapons, machine guns, and other firearms exposed to prolonged use under extreme conditions.

The tubular sleeve provides at least approximately an 80 percent decrease in temperature as the heat transfers from the barrel, through the heat resistant layers, and into the outermost layer. An 80 percent reduction in heat transfer from the barrel to the outermost layer implies that if the barrel's surface temperature is, for example, 1000 degrees Fahrenheit, the temperature impacting the outermost layer would only be about 200 degrees Fahrenheit. Using alternative materials, adding more heat layers, and/or enhancing shielding can further increase heat dissipation, thereby decreasing the temperature of the heat on the outermost layer and potentially making the system even more efficient. More specifically, by the time the heat reaches the outermost layer, the temperature of the heat is at most 20 percent of the heat from the barrel of the firearm.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The invention claimed is:

1. A heat retardant system for covering a barrel of a firearm, the heat retardant system comprising:

a tubular sleeve comprising a first end portion and a second end portion;

an innermost layer of the tubular sleeve, wherein the innermost layer of the tubular sleeve comprises a heat tolerant material defining a retardant channel extending through the tubular sleeve configured to substantially cover the barrel of the firearm;

an outermost layer the tubular sleeve attached to the innermost layer of the tubular sleeve;

a first opening at the first end portion of the tubular sleeve;

a second opening at the second end portion of the tubular sleeve; and a fastener attached to opposing sides of the first end portion of the tubular sleeve;

a first section on the outermost layer of the tubular sleeve proximate to each of the first end portion and the second end portion, wherein the first section is defined by the innermost layer of the tubular sleeve wrapping about a perimeter of each respective end portion and covering at least a portion of the outermost layer;

wherein the tubular sleeve is configured to span substantially all the barrel of the firearm;

wherein the fastener is configured to secure the tubular sleeve to a rearward portion of the firearm.

2. The heat retardant system of claim 1, wherein the first opening receives the barrel of the firearm and wherein the second opening provides heat dissipation from the barrel.

3. The heat retardant system of claim 2, wherein the fastener is an elastic cord coupled to the tubular sleeve for attaching to the rearward portion of the firearm.

4. The heat retardant system of claim 3, wherein the heat tolerant material comprises a heat resistance of up to 1800 degrees Fahrenheit.

5. The heat retardant system of claim 4 comprising a rigid stabilizer on at least one of (i) a top portion and (ii) a bottom portion of the tubular sleeve, wherein the rigid stabilizer extends longitudinally about of the tubular sleeve for maintaining the tubular sleeve in an upright position.

6. The heat retardant system of claim 5, wherein a side of the tubular sleeve comprises a cutout extending at least partially the length of the tubular sleeve, wherein an opening of the cutout receives an attachment to the firearm.

7. The heat retardant system of claim 6, wherein the cutout is on a bottom facing portion of the tubular sleeve and extends from a middle portion of the tubular sleeve to the first end portion of the tubular sleeve for sliding over the attachment to the firearm.

8. The heat retardant system of claim 7 further comprising a plurality of vents about the tubular sleeve, the plurality of vents extending through the outermost layer of the tubular sleeve to the innermost layer.

9. A heat retardant system for covering a barrel of a firearm, the heat retardant system comprising:

a planar body having a bottom side and a top side, wherein the bottom side comprises a heat resistant layer and the top side comprises an outermost layer;

a perimeter extension of the heat resistant layer, wherein the perimeter extension wraps around a perimeter edge of the planar body to cover at least a margin of the outermost layer on the top side;

a first fastener;

a second fastener configured to removably mate with the first fastener;

a third fastening mechanism having a first end and a second end, wherein the first end is coupled to a lateral side portion of the planar body, and the second end comprises an attachment mechanism configured to removably attach to a rearward portion of the firearm;

a substantially tubular sleeve configuration comprising the first fastener mated with the second fastener such that the heat resistant layer on the bottom side of the planar body forms an innermost later of the substantially tubular sleeve configuration, and wherein the substantially tubular sleeve configuration comprises a barrel channel; and an operational configuration wherein the heat retardant system in the substantially tubular sleeve configuration is configured to substantially surround at least a portion of the barrel of the firearm wherein the third fastening mechanism is configured to extend rearwardly from the lateral side portion of the planar body to the rearward portion of the firearm.

10. The heat retardant system of claim 9, wherein the heat resistant layer comprises:

a first heat resistant layer comprising a first plurality of apertures; and a second heat resistant layer comprising a second plurality of apertures;

wherein the second heat resistant layer is offset relative to the first heat resistant layer such that the first plurality of apertures of the first heat resistant layer are substantially occluded by the second heat resistant layer.

11. The heat retardant system of claim 9 wherein the heat resistant layer is capable of withstanding temperatures ranging up to 1800 degrees Fahrenheit.

12. The heat retardant system of claim 9, further comprising a padding layer disposed between the heat resistant layer and the outermost layer, wherein the padding layer provides additional thermal insulation and shock absorption.

13. The heat retardant system of claim 9 further comprising a temperature reactive indicator disposed on the outermost layer to indicate a heat status of the barrel of the firearm.

14. The heat retardant system of claim 9 comprising a rigid stabilizer on the top side of the planar body that extends longitudinally on the planar body when in the substantially tubular sleeve configuration.

15. The heat retardant system of claim 9 further comprising a plurality of vents about the planar body, the plurality of vents extending through the outermost layer of the planar body to the heat resistant layer.

16. The heat retardant system of claim 9, wherein the planar body comprises at least one of (i) a cutout and (ii) an opening for securing the heat retardant system in the operational configuration over attachment of the firearm.

17. A heat retardant system for covering a barrel of a firearm, the heat retardant system comprising:

a planar body comprising:

a heat resistant layer on a bottom portion of the planar body, the heat resistant layer comprising:

a first heat resistant layer comprising a first plurality of apertures; and a second heat resistant layer comprising a second plurality of apertures;

wherein the second heat resistant layer is offset relative to the first heat resistant layer such that the first plurality of apertures of the first heat resistant layer are substantially occluded by the second heat resistant layer;

an outermost layer on a top portion of the planar body;

an intermediate layer disposed between the heat resistant layer and the outermost layer;

a perimeter extension of the heat resistant layer, wherein the perimeter extension wraps around a perimeter edge of the planar body to cover at least a margin of the outermost layer on the top portion;

a first fastener;

a second fastener configured to mate with the second fastener;

an elastic cord having a first end and a second end, wherein the first end is coupled to a lateral side portion of the planar body, and the second end comprises an attachment mechanism configured to removably attach to a rearward portion of the firearm;

a temperature reactive indicator disposed on the outermost layer to indicate a heat status of the barrel of the firearm;

wherein the heat resistant layer is capable of withstanding temperatures ranging up to 1800 degrees Fahrenheit;

a substantially tubular sleeve configuration comprising the first fastener mated with the second fastener such that the heat resistant layer on the bottom portion of the planar body forms an innermost later of the substantially tubular sleeve configuration, and wherein the substantially tubular sleeve configuration comprises a barrel channel; and an operational configuration wherein the heat retardant system in the substantially tubular sleeve configuration configured to substantially surround at least a portion of the barrel of the firearm wherein the elastic cord is configured to extend rearwardly from the lateral side portion of the planar body to the rearward portion of the firearm.

18. The heat retardant system of claim 17 further comprising:

a rigid stabilizer on the top portion of the planar body that extends longitudinally on the planar body when in the substantially tubular sleeve configuration; and at least one of (i) a cutout and (ii) an opening for securing the heat retardant system in the operational configuration over an attachment of the firearm.

* * * * *